US006803862B2

(12) United States Patent
O'Connor et al.

(10) Patent No.: US 6,803,862 B2
(45) Date of Patent: Oct. 12, 2004

(54) COMMUNICATION SYSTEM

(75) Inventors: Michael O'Connor, Blackrock (IR); Aubrey Thompson, Dublin (IR)

(73) Assignee: Knack Investments Limited, County Dublin (IE)

( * ) Notice: Subject to any disclaimer, the term of this patent is extended or adjusted under 35 U.S.C. 154(b) by 176 days.

(21) Appl. No.: 09/986,616

(22) Filed: Nov. 9, 2001

(65) Prior Publication Data

US 2002/0049054 A1 Apr. 25, 2002

Related U.S. Application Data

(63) Continuation of application No. PCT/IE00/00062, filed on May 12, 2000.

(30) Foreign Application Priority Data

May 12, 1999 (IR) ..... 990382

(51) Int. Cl.[7] ..... G08G 1/123
(52) U.S. Cl. ..... 340/994; 340/989
(58) Field of Search ..... 340/988, 989, 340/990, 991, 992, 993, 994; 701/117, 207, 211

(56) References Cited

U.S. PATENT DOCUMENTS

| | | | | | |
|---|---|---|---|---|---|
| 4,799,162 | A | | 1/1989 | Shinkawa et al. | 340/994 |
| 5,218,629 | A | * | 6/1993 | Dumond, Jr. et al. | 340/904 |
| 5,602,739 | A | | 2/1997 | Haagenstad et al. | 340/906 |
| 5,664,948 | A | * | 9/1997 | Dimitriadis et al. | 340/989 |
| 5,739,774 | A | * | 4/1998 | Olandesi | 340/994 |
| 6,060,993 | A | * | 5/2000 | Cohen | 340/988 |
| 6,313,760 | B1 | * | 11/2001 | Jones | 340/994 |
| 6,374,176 | B1 | * | 4/2002 | Schmier et al. | 340/994 |
| 6,584,403 | B2 | * | 6/2003 | Bunn | 340/988 |

FOREIGN PATENT DOCUMENTS

GB 2281141 A 2/1995

* cited by examiner

*Primary Examiner*—Brent A. Swarthout
(74) *Attorney, Agent, or Firm*—Jacobson Holman PLLC

(57) ABSTRACT

A host system (2) receives uploaded real time bus progress data (20) for bus systems (13). This is determined by the bus system (13) detecting a beacon short range radiation signal from a bus stop systems (11). Uploads are only made if the bus is not running according to the timetable. The host system (2) downloads bus status data (21) for remaining stops (12) on the route. The host system (2) also downloads advertising content to both the bus stop systems (11) and the bus systems (13). This is intelligently processed to select that which is applicable.

4 Claims, 3 Drawing Sheets

COMMUNICATION SYSTEM

Figure 1:
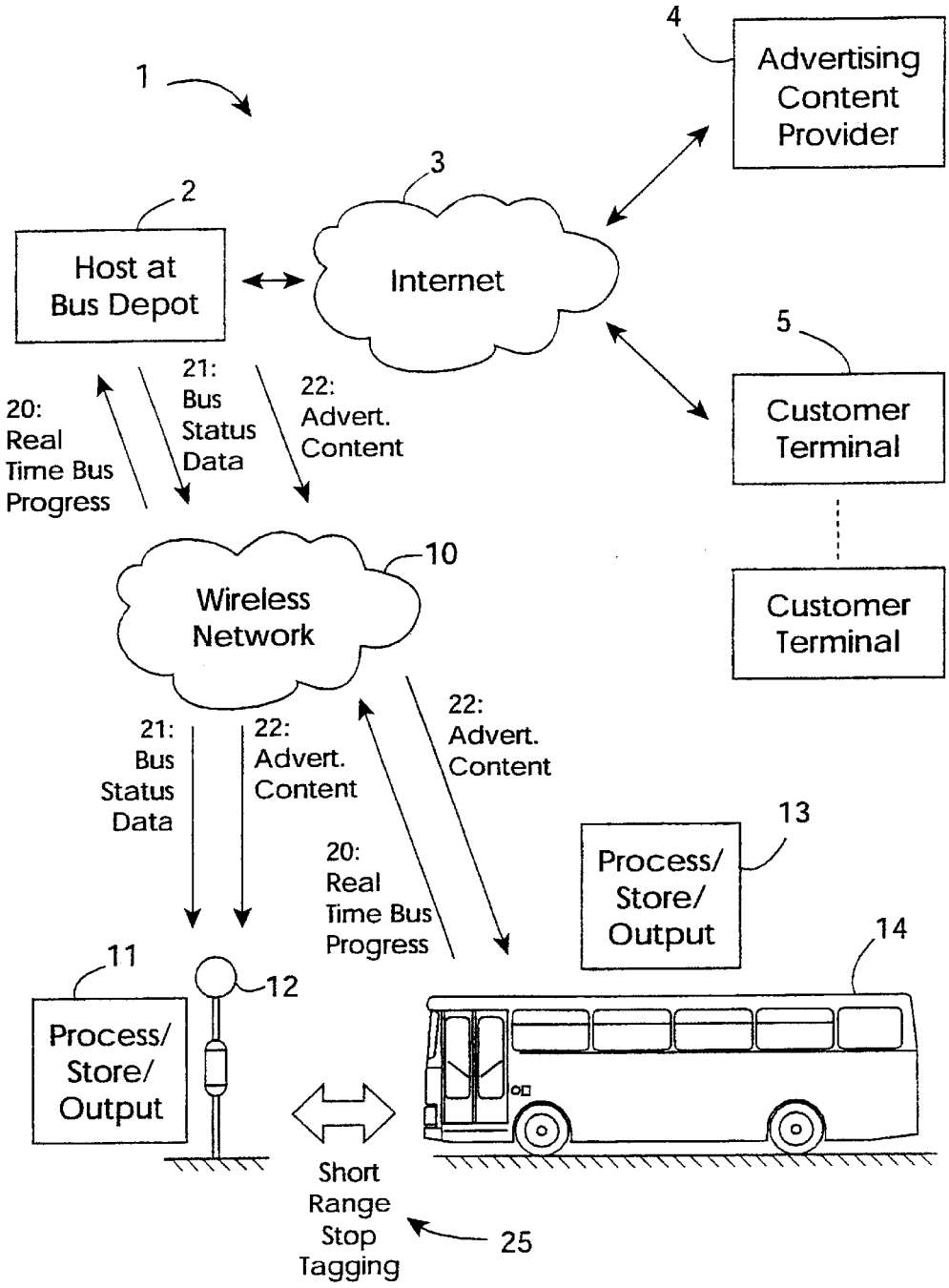

This is a continuation of PCT/IE00/00062 filed May 12, 2000 and published in English.

FIELD OF THE INVENTION

The invention relates to communication of information for transport organisations having vehicles and fixed locations at which they stop. An example is a public transport bus company.

PRIOR ART DISCUSSION

Existing communication systems for such organisations typically involve two-way radio contact between drivers and the central depot and also a system in the depot which stores route and resource data for employees such as drivers and inspectors. Communication of information to passengers is limited to loudspeaker systems at bus depots/stations and display of route and timetable data notices at bus stops.

This is inadequate because there is often very limited knowledge of when a vehicle is likely to reach its destination.

OBJECTS OF THE INVENTION

Therefore, the invention is directed towards providing for more comprehensive communication of information for transport organisations.

Another object is to provide an opportunity for transport organisations to raise additional revenue to help provide a better transport service.

SUMMARY OF THE INVENTION

According to the invention, there is provided a communication system for public transport vehicles, the system comprising a host system comprising means for wireless communication with vehicles, and vehicle systems in vehicles comprising means for communication with the host system, characterised in that, the system further comprises a vehicle stop system located at each of a plurality of vehicle stops along vehicle routes;

the vehicle systems and the vehicle stop systems comprise means for communicating with each other to determine real time vehicle progress data with respect to a route;

each vehicle stop system or each vehicle system comprises means for uploading the real time vehicle progress data to the host system;

the host system comprises means for receiving the real time vehicle progress data and for using said data to broadcast vehicle status data; and each vehicle stop system comprises means for receiving and outputting said vehicle status data.

In this specification, the term "vehicle" is intended to cover any vehicle such as a bus or delivery lorry which travels on a pre-set route. The term "vehicle stop" is intended to cover any fixed location which a vehicle visits or passes such as a goods pick-up depot for a delivery lorry or a bus stop.

In one embodiment, real time vehicle status data is exception data uploaded only when a vehicle is not adhering to a timetable for a route.

In one embodiment, each vehicle stop system or each vehicle system comprises means for storing and processing route data to determine when an exception occurs.

In another embodiment, each vehicle stop system comprises means for emitting short range beacon signals, and each vehicle system comprises means for detecting such signals and processing them to determine the real time vehicle progress data.

In one embodiment, each vehicle system comprises means for uploading the real time vehicle progress data.

In one embodiment, the host system, the vehicle stop systems, and the vehicle systems comprise means for communicating via a wide area wireless network.

In another embodiment, the host system comprises means for performing group call broadcasting to group family members.

Preferably, said broadcasting means comprises means for embedding qualifiers in messages to allow recipients to ignore selected received messages.

In one embodiment, the host system comprises means for downloading software updates in an over-the-air programming mode.

Preferably, the host system comprises means for maintaining a configuration file indicating version and validation of stored software, and means for updating the configuration file after a download.

In one embodiment, each vehicle stop system and each vehicle system comprises means for uploading an indication to the host system if operating in a fallback mode, and the host system comprises means for downloading a software update in response.

In one embodiment, the host system comprises means for using a software update instruction set including change directory, process termination, process run, file copy, file rename, and file delete instructions.

In another embodiment, the host system comprises means for polling the vehicle systems and the vehicle stop systems to determine if they are in fallback mode.

In one embodiment, said software update instruction set comprises short symbols representing said instructions, for reliability of remote transmission of instructions In one embodiment, the host system comprises a message controller and a database, and the message controller comprises means for maintaining execution threads for:

monitoring a dataset of outbound messages awaiting download, and monitoring a dataset of inbound messages.

In a further embodiment, the host system comprises means for downloading advertising content and the vehicle stop systems and the vehicle systems comprise means for receiving and outputting advertising content.

In one embodiment, the host system comprises means for broadcasting the advertising content, and each vehicle stop system and each vehicle system comprises means for selecting from received content according to advertising criteria including route data.

In one embodiment, the host system comprises means for broadcasting advertising content during off-peak time periods.

Preferably, the host system comprises means for broadcasting advertising content at least twice to increase probability of success.

In another embodiment, the host system comprises means for associating a unique code to each of a plurality of advertisements, and for associating a null code when an advertisement is discontinued.

In one embodiment, the host system comprises means for predicting arrival times based on both the real time vehicle progress data and a vector having a start time and intervals to stops in route time units.

DETAILED DESCRIPTION OF THE INVENTION

Figure 2:
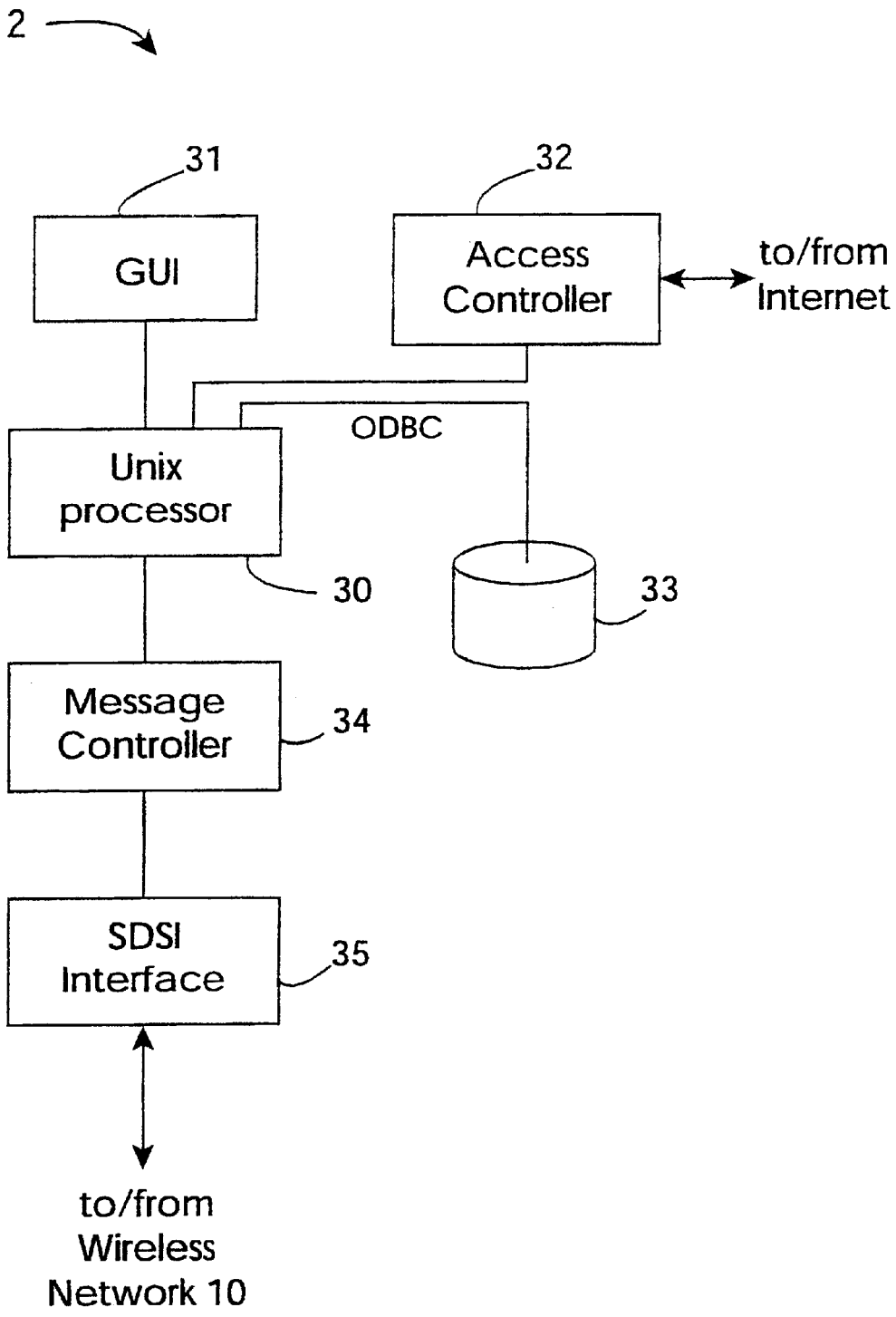
Figure 3:
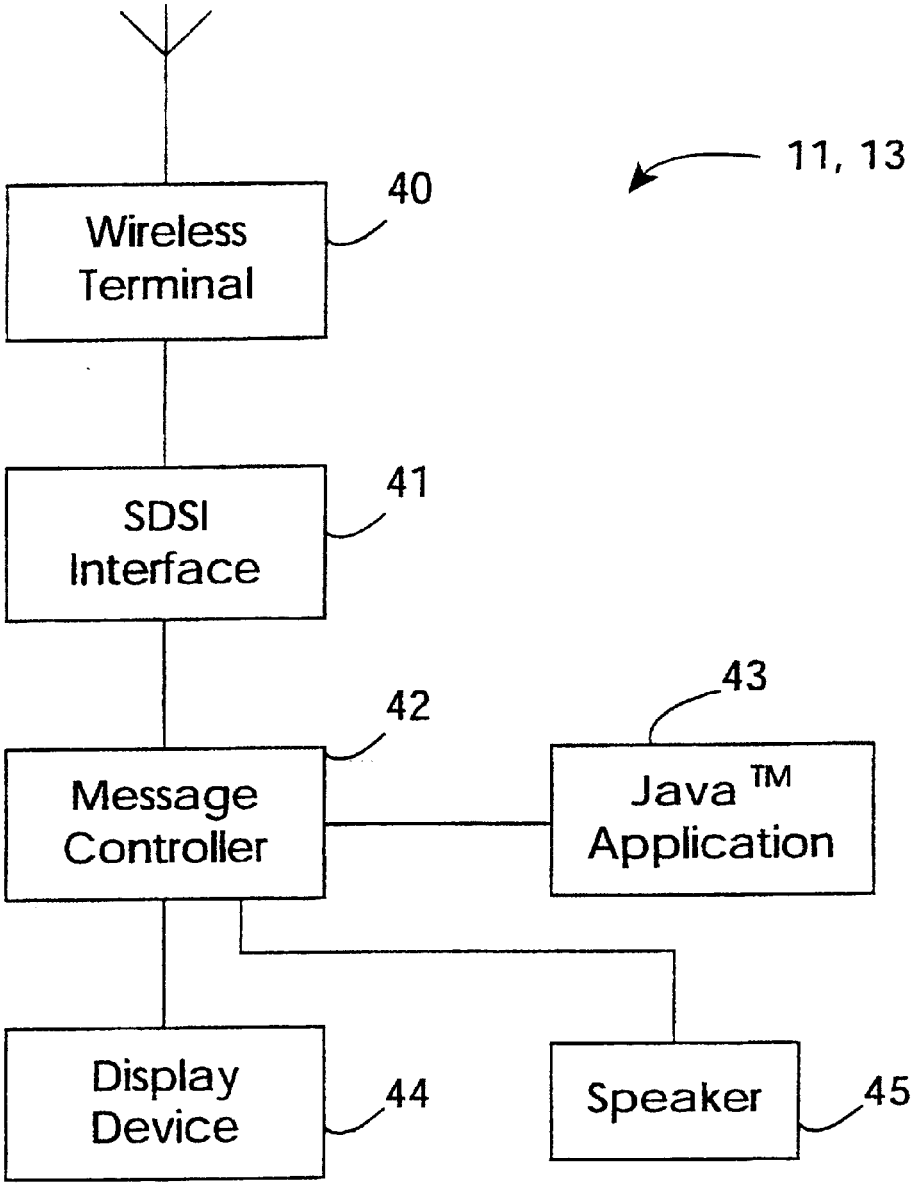

The invention will be more clearly understood from the following description of some embodiments thereof given by way of example only with reference to the accompanying drawings in which:

FIG. 1 is a diagram illustrating a communication system and interaction of components of the system; and FIGS. 2 and 3 are diagrams illustrating host and remote systems respectively in more detail.

DESCRIPTION OF THE EMBODIMENTS

Referring to FIG. 1 a communication system 1 comprises a host system 2 located at a central depot, in this embodiment a bus depot. The host system 2 communicates via the Internet 3 with external systems including an advertising content provider 4 and customer terminals 5. The latter are typically PCs in the home or workplace. In addition to the Internet 3, the system 1 also makes use of a wireless network 10, in this embodiment a TETRA public wireless network. However, other networks such as those known as HSCSD, UMTS, GPRS could alternatively be used. The wireless network 10 allows the host system 2 to link with a system 11 at each bus stop 12 and with a system 13 in each bus 14. The bus stop and bus systems 11 and 13 are part of the overall system 1, and they comprise means for communicating with each other via a short range ratio link.

Within the system 1, the major signal interactions are:

20: Transmission of real time data indicating current location of a bus with respect to its route; from buses 14 to the host 2.

21: Transmission of processed real time bus progress data, called bus status data, from the host 2 to the bus stops 12. This data included expected bus arrival times.

22: Transmission of advertising content from the host 2 to both the bus stops 12 and to the buses 14.

25: Bi-directional short range bus/bus stop tagging for the bus to determine its current location. This is then used to generate the real time bus progress data 20.

Referring to FIG. 2, in more detail, the host 2 comprises a Unix™ processor 30 with user interface and remote access control functions 31 and 32 respectively. An ODBC database 32 stores bus resource, bus route, bus timetable, and messaging data. The Unix™ processor 30 uses a message controller 34 and an SDSI interface 35 for communication via the wireless network 10.

Referring to FIG. 3, at the hardware level the bus stop and bus systems 11 and 13 are similar and are illustrated in a single diagram. A wireless terminal 40 is connected to an SDSI interface 41. A message controller 42 outputs messages under control of a Java™ application 43. The output devices include a display device 44 and a speaker 45. The display devices 44 comprise LCD screens.

The bus system 13 monitors adherence to a timetable using stored timetable data to generate the real time bus signals 20. These signals include only exception data because they are only transmitted when the bus system 13 determines that the bus is running late or early. The host 2 uses the received real time bus progress data 20 to broadcast the bus status data 21. The latter may be a copy of the former, or as in this embodiment it includes a good deal of "added value" information predicting arrival times at downstream stops 12.

The advertising content signals 22 are derived from uploads from content providers 4 via the Internet 3. New content is broadcast to all buses 14 and bus stops 12, and the systems 11 and 13 process the received contecnt to decide to accept or reject according to pre-programmed knowledge specific to the particular bus stop 12 or bus 14. The signals 22 are not broadcast in real time, but instead are broadcast overnight in three transmissions to ensure successful capture. The processing in the systems 11 and 13 is carried out immediately as they do not have the memory capacity to store all of the received content.

The host 2 maintains a dynamic real time table of bus status data which is assessable to customers via their terminals 5 and the Internet 3. The host 2 also maintains a file which contains a list of configuration files against each of which is stored the version number and a parameter which indicates validation of software in the system 1. When a change is made to his file an OTAR (Over-the-air-Reprogramming) update instruction reads the file to find the version number requested and loads it if the validity indicator showed that it was valid. If the validity indicator showed that it was not valid then the host 2 seeks out the previous record and checks that for validity until a valid software load had been found. Each time an OTAR download instruction is executed the process of receiving and registering the file results in the entire list of configuration files being validated. It is necessary that the entire list is validated because an error may have left a previous configuration invalid and the present download has caused that to become valid. An OTAR delete instruction also needs to result in a validation process which checks that the file being deleted is not part of the present software load.

The host 2 is robust, as the software fails to a position from which it may recover. There will remain a possibility that a control file within the manager may be accidentally overwritten or otherwise destroyed. If the process of finding and reading the required configuration from the control file should fail, then the software manager includes a default process under which it operates the most basic next bus function.

To start the OTAR process, the host 2 is capable of responding to signals that a system 11 or 13 is in fallback mode. The host 2 routinely individually polls the bus stops. The time period at which this is done varies with the load on the system. Polling each system 11 and 13 every 24 hours has been set as the standard time interval, but the host 2 has the option of suspending polling in favour of more profitable radio traffic.

Referring again to FIG. 2, the message controller provides radio connectivity to the core database 33. This component allows it to communicate with the systems 11 and 13. The message controller 34 is responsible for securely allowing this transfer. This component is located on a different platform from the database 33 but is located in proximity to radio interface software. The controller 34 maintains two core threads of execution. One monitors the database 33 for messages that need to be sent out and the other processes inbound messages. On start-up of either process a connection is made to the database 33 which persists during the program life span. This connection is made via ODBC (in which case standard SQL can be used to interrogate/maintain the database) or the information can be passed through a TCP/IP socket and the database requests can be serviced by a database program running at the database end. For outbound messages this thread polls the database's outbound message table (outbound_messages) for text which needs transmitting out from the attached radio unit. For an outbound message, this table provides the unique code of the system 11 or 13 to transmit to, total message size and information to send. Where the information to be sent is a simple text message, the text is found in the table and transmitted through the interface 35. Where the message is a large object (e.g. multimedia) the table provides a pointer to the large object data and the full object data is selected and sliced into small data packets before transmission via the interface 35. This process is partly responsible for ensuring that the recipient receives the message.

Inbound messages received by the radio are automatically detected by the interface and 35 sent to the database 33. This data is then processed by the processor 30.

For message processing, a process runs in the background regularly monitoring an inbound message table. When a message is found, the process breaks it up into components based on the system's message structures. The message indicates the source address of the message, and the type of message it is. Also contained is any other information that allows the message to be processed. This process is responsible for processing, storing and acting upon the message data. In some cases, the processing generates outbound messages. In this case, messages are placed in the outbound message area, to be picked up by the message controller, 34. This performs the following:

Handle time processing (and subsequent creation of bus status data messages)

Handle driver emergency message processing

Referring to FIG. 3, the bus system 13 maintains a record of where it should be on the route and its progress against the timetable. It informs the host 2 about any delays which occur, and it monitors the receipt of any bus stop beacon signals with short range tagging. As the bus proceeds along the route it seeks the transmission from each successive beacon. The wireless terminal 40 is a short range wireless transmitter in the case of the bus stop system 11 and is a short range wireless receiver in the case of the bus system 13. The transmitted data identifies the stop 12 and is used by the system 13 to determine if the bus is off-schedule and to generate an output indicating the location to passengers. The range is 100 m.

The strategy for the communication of advertising material is based on a series of policies, these are as follows.

The information is broadcast to all buses using group call broadcasts.

The intelligence concerning whether the bus needs this information is located in the bus.

The transmissions are sent at night and are evenly spread across the period of time available.

The use of wireless network group call facility to broadcast to buses is more efficient than is attainable using one-to-one communications, and is used for both download of advertising content and bus status data. A secondary advantage of the use of broadcast data is that it permits the bus to make the decision concerning whether it needs to receive the message. A one-to-one system would be prone to errors resulting from information being inadequately updated. A consequence of the use of broadcast messages is that it maximises the chance of every bus receiving the entire message. The method used to achieve this involves repetition of the message sequence, and the message is sent a number of times up to three times. In group call broadcasting, group family members are maintained to include both mobile and fixed recipients. The broadcasts include qualifiers which have the effect of allowing certain receivers to ignore the broadcast, for example advertising content which is not relevant. The group call functionality is provided by the wireless network 10.

An advantage of having the intelligence in the bus is that it overcomes human error. The bus system 13 knows where the bus is and which route it is running. This information is used as a check on the information sent to the bus and the system 13 uses its intelligence to decide how much of the information which is sent to it is relevant to it. Thus, the administrative effort required by both the bus operators and the despatchers of the advertising is reduced. The method by which this is achieved relies on the fact that the bus system 13 has a record of the routes on which it is likely to be used and the advertisement details will be destined for certain routes. The bus system 13 only selects the advertisements which are relevant for the routes which it might travel.

In general, a primary reason that radio communications fail to function is that the receiving device is located in an area to which the radio signals cannot penetrate. However, a bus is a large object and the usual problems such as poor in-building coverage or multi-story car parks are unlikely to affect it. There remain a range of lesser reasons for failure such as:

Radio turned off during maintenance.

Vehicle temporarily out of range.

Localised electrical noise ie. vehicle ignition noise, welding, illegal radios.

These can all cause temporary loss of communication, however, if the transmission is spread across the available time period then the chances of a failure of this type being present throughout that time is minimised.

The advertising transmissions are sent at night during a period of low load, spreading them such that a very small proportion of the total message is sent within a particular time interval. This minimises the probability of complete message loss. A secondary benefit of using this technique is a reduction of the influence of any poorly designed telemetry applications which may be sharing the network. When correctly designed these impose a very low load on the data facilities of the network. The system 1 has time to check for failures due to network congestion and to resend packets as required.

It is possible that an advertisement may only have validity for a range of restricted time periods during the day. These are stored as a start time, expressed as hours and minutes, and a finish time having a similar form. Each time period may also only be valid for a limited range of days and these can be expressed in a number of different ways such as relative to a week, to a month, or to an absolute date.

Examples of these include advertisements which are only required on one of the days of the week, or of the month. For example, a number of magazines are published on certain days and it would be a service to the publisher if the advertisement for them appeared on that day and on a few days afterwards to remind regular readers. When the route information provides the basis for the geographic limits of where the advertisement shall be shown, then it will be necessary that the route information concerning where it is played will require more detail than the route information which governs whether it is stored on the computer. Under certain circumstances the display routes may be a subset of the routes for which data is stored.

The route information for display may include the bus stops 12 between which the display must be shown for the direction of travel. Typically this would be used by stores wishing to notify their potential customers of their offerings as the bus approached the store. For these reasons it is necessary to separate the routes as expressed in the selection process from those used in the display process.

One of the practical problems which must be overcome is to ensure that the bus has stored the routes which it will be using. The system has been designed to overcome human error by providing a link between the route management data and the advertising data. The routes for which advertisements are accepted are only those for which the bus has routes stored in its database. When a bus changes routes on either a temporary or a permanent basis, then it is preferable that the new routes are downloaded by the despatchers in the bus company.

A bus may be transferred permanently to another garage or temporarily for use on a limited range of routes. It might also be used on a special route for one day only, perhaps a football special. For all "specials" it is important that the route is downloaded the day before so that the advertisements which are specific to that route may be loaded onto the bus during the intervening night.

There remains the possibility that the data will not be downloaded or that a bus will be diverted at short notice. The following procedure helps to ensure that the bus receives any advertising which is appropriate to its new state. The process commences when the driver attempts to start a route for which the computer does not have a route:

The driver enters an unrecognised route, the computer responds by asking him to confirm it.

If the second attempt is identical and still unrecognised then the bus will make a request to the central computer asking if this is a valid route.

If the computer states that it is invalid then the driver will be invited to try again to enter the route. If it is valid then the despatcher will be asked if the driver may proceed on this route If the despatcher confirms that the driver may drive the route then the computer asks the dispatcher whether this is a temporary addition of a route or a permanent move between garages.

For a permanent change of garages the old routes will be replaced with the new routes. For a temporary change the route used will be added to the bus list.

The process of selecting which advertisements the bus system 13 stores and which it discards is controlled by the associated routes which are stored in the system 13. Each advertisement is identified in the bus system 13 by a PIN number. This is effectively the advertisement number. It is a 16 bit integer number, and so there may be up to 65535 advertisements in the system at any one time. The advertisement retains its PIN number for its life. Advertisements may be updated or deleted. When a PIN number is no longer in use it may be re-used for another advertisement. The re-use of PIN numbers permits new advertisements to be despatched even when the fill cycle of 65,535 advertisements has been completed. An advertisement may be invalidated on buses by sending them a set of display instructions in which the version number is zero (NULL).

An advertisement therefore comprises the following files:

Route List

Play List

Content List

Content Files

As stated above, advertisements are downloaded during the night. An advertisement may be a new advertisement, a replacement for an existing one or a supplement to some existing information. Each advertisement needs a route list and a play list before the advertisement is downloaded. In the case of new advertisements these will be downloaded, for existing advertisements the route list and play will remain unchanged unless there is a need to change either of them.

The first task of a download is to download route lists and play lists because an advertisement will not be stored unless there is a valid route list for that PIN number. The process of downloading then commences with a packet which links a tag number to the PIN number of the advertisement. The computer will then seek out packets for which the protocol identifier indicates that it is an advertisement file and the tag number is stored on the computer.

This process of linking the PIN number to the tag number takes place twice firstly as a night-load file which is sent three times early in the evening and which shows all of the files which will be sent. Then there should be a leading packet for each file showing the linkage for the following file only.

The advertisement files require a very large number of packets. There is a significant advantage to be derived from spreading the broadcasts over the maximum possible period because:

A common cause of the system 13 failing to receive a message is that it is out of coverage for a brief period, if the downloading process is spread over an extended period the amount of data lost is minimised.

Terminals lose messages during maintenance because the power to the radio is often turned off. A second transmission later in the night overcomes this problem.

A bus may be taking part in a special route which extends beyond the normal constraints of the service. An extended transmission maximises the probability that it will catch at least one of the transmissions.

There may be other network users who have ill designed applications which place sudden loads on the network at times during the night. The slowing down effect of these is minimised if the bus application packets are spaced out.

In order to carry out this process of spreading out the load, the following procedure is employed:

A period of time early in the night is assigned to the downloading of route files, play files and the linkage file.

The remaining time is divided into three parts which are grouped as two parts for the download of data and one part for the correction of errors.

The files to be sent are broken down to packets and the number of repeats are also calculated. The sequence of transmissions of the files is such that an of the files are transmitted once and then repeated as required for the number of repeats.

The total number of packets is divided into the time available and the result is the send interval.

The packets are then sent at the send interval.

When the packets have been sent the systems 11 and 13 will request corrections for those packets which are still missing at the end of the process. If a file is less than a configurable percentage (roughly 85%) complete then additional packets should not be requested and the file should be discarded (a file which is less than 85% complete after three repeats has failed due to an irredeemable problem).

The process of transporting the data commences with the transmission of the linking files, each of which represents a file which will be sent across the radio system. For each file, space must be reserved in the memory to which the segments of the file may be written. For each file there is also a record which includes the tag number and the file name. This record refers to an array of addresses which shall be calculated on the basis that each one points to the start of the position of the individual segments which shall be re-assembled. This calculation is based on the start position and the packet length. The array of addresses need not be physically present and may calculated on an as-required basis ie. file address= segment length×segment number, but a record is needed to show whether the segment has been completed or not.

The downloading process is configurable using the linkage file for the tag number. The number of sends and resends can be amended as can the percentage complete after which the file is abandoned. The update timer can be configured for each file but this will not make a great difference to the efficiency with which the files are downloaded. The time of transmission of the final transmission of a file may also be amended to spread the load on the network. The update delay which is defined in the linkage file may be used to delay the beginning of the updating process. This feature would be used at times when the downloading process is expected to be very intense and there is a desire to delay the updates into the working day.

The following describes over-the-air programming of the system 11 in more detail. For any action which a system 11 or 13 carries out it will be necessary that it can access stored data which permits it to perform the correct calculations. Such data is obtained as a result of the system listening for those data records which are of relevance to it. These records are delivered or replaced in their entirety so that the packet which is transmitted is likely to be identical or very similar to that which is stored in the file. Record structures are convertible to packet structures by the addition of a protocol ID and the variable types.

There is an instruction set which permits a software manager of each system 11 or 13 to move, delete, load, and halt software elements. The host 2 activate these functions using an instruction set having only one or two characters per functions. The symbols are listed in the second column below.

| | |
|---|---|
| Change directory | cd |
| Go | g |
| Kill a process | k |
| Run a Process | s |
| Copy a file | c |
| Delete a file | d |
| Rename a file | r |

There is a requirement that it shall be possible to run a piece of software for a period of time and to then revert to the original version. This is be achieved by including a time in the run command and following the filename with the name of the file to be run when the time is complete and the process has been killed. This second file could of course be a job control file which causes a number of actions to take place.

Regarding timetables, the bus system 13 needs:

times at each point at which there is a beacon, the ability to change to cope with short or long term changes in route, the ability to find the times which are actually used instead of those which have been estimated in the past, both when a new bus route is added to the system or at any other time that a variation of the times is considered to be necessary, the ability to vary with the time of the day to cope with rush hours, the ability to vary to cope with very inclement weather, The dynamic information on the routes primarily comprises the time at each stop relative to the start time of the route. The system 11 stores the delay after the commencement of the route at which the bus is likely to arrive at the bus stop. This time is expressed in units which are small enough to permit accurate control. A time interval of one second is the minimum reasonable increment whilst a six second interval approximates to the maximum.

Very often, the time period to complete the route will vary significantly with the time of day, and the traffic, weather and many other factors including the following.

Road works have diverted traffic onto the route.

A sale at a shop near to the route.

Loading and unloading.

Roadworks on the route.

Variations to the curbside car parking.

Tree branches growing across the road.

School-related traffic at particular times.

In order to cope with these variations the host system 2 is programmed to dynamically select a relevant timetable. The host system 2 stores for each route a range of route time interval vectors, each of which is identified by a route time interval vector number (RTIV number). Each vector contains the following data:

Route number

Issue number of the route

RTIV number

Bus stop 12 interval.

Depending on real time bus progress data 20, the host 2 dynamically selects a relevant RTIV. For example, it may decide that the next bus should use a slower RTIV. If this one were also delayed then the next bus would leave using an RTIV which is two stops slower and so on. Similarly when the bus started to gain relative to its RTIV then the next bus would have a faster RTIV. In this way the system would flex under the influence of the real traffic which the buses encounter and respond to it. It is possible to use this feature to assist the process of maintaining interval control in the larger cities. The technique of flexing the RTIV is particularly appropriate when buses are despatched at regular intervals because the responsiveness of the traffic conditions to changes in the source of delay is sufficiently fast that when the time interval is longer the progress of the previous bus is not a good guide to the progress of the next one.

In order to permit good quality bus status data 21 to be extracted it is helpful that the times achieved by the buses during a period of a few weeks are collected by the buses and reported at the end of the route. A real time timetable is created from interval timings collected over a one month period. This procedure assists in generating the interval class (the operator will have the choice of generating simple time-banded timetables or complex real-time timetables which will give the expected arrival time for every bus at every stop on every route). The preferred option for ease of implementation is the simple approach.

The invention is not limited to the embodiments described but may be varied in construction and detail within the scope of the claims.

What is claimed is:

1. A communication system for public transport vehicles, the system comprising:

a host system comprising means for receiving real time vehicle progress data to wirelessly transmit vehicle status data;

vehicle systems for vehicles and comprising means for communication with the host system;

vehicle stop systems for location at each of a plurality of vehicle stops along vehicle routes; and means in the vehicle stop systems or in the vehicle systems for determining and uploading the real time vehicle progress data to the host system; wherein the host system comprises means for downloading software updates in an over-the-air programming mode and means for downloading advertising content, and the vehicle stop systems and the vehicle systems comprise means for receiving and outputting advertising content; and each vehicle stop system and each vehicle system comprises means for uploading an indication to the host system if operating in a fallback mode, and the host system comprises means for downloading a software update in response.

2. The communication system as claimed in claim 1, wherein the host system comprises means for using a software update instruction set including change directory, process termination, process run, file copy, file rename, and file delete instructions.

3. The communication system as claimed in claim 2, wherein said software update instruction set comprises short symbols representing said instructions, for reliability of remote transmission of instructions.

4. A communication system for public transport vehicles, the system comprising:

a host system comprising means for receiving real time vehicle progress data to wirelessly transmit vehicle status data;

vehicle systems for vehicles and comprising means for communication with the host system;

vehicle stop systems for location at each of a plurality of vehicle stops along vehicle routes; and means in the vehicle stop systems or in the vehicle systems for determining and uploading the real time vehicle progress data to the host system; where the host system comprises means for downloading software updates in an over-the-air programming mode and means for downloading advertising content, and the vehicle stop systems and the vehicle systems comprise means for receiving and outputting advertising content; and the host system comprises means for polling the vehicle systems and the vehicle stop systems to determine if they are in fallback mode.

* * * * *